US007922473B2

(12) United States Patent
Gelli et al.

(10) Patent No.: US 7,922,473 B2
(45) Date of Patent: Apr. 12, 2011

(54) ROLLER WITH INTERCHANGEABLE SLEEVE FOR EMBOSSING UNITS AND EMBOSSING UNITS COMPRISING SAID ROLLER

(75) Inventors: Mauro Gelli, Lucca (IT); Valter Di Nardo, Lucca (IT); Fabrizio Lorenzi, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 575 days.

(21) Appl. No.: 11/579,390

(22) PCT Filed: May 3, 2005

(86) PCT No.: PCT/IT2005/000254

§ 371 (c)(1),
(2), (4) Date: Feb. 8, 2007

(87) PCT Pub. No.: WO2005/105422

PCT Pub. Date: Nov. 10, 2005

(65) Prior Publication Data

US 2007/0246166 A1 Oct. 25, 2007

(30) Foreign Application Priority Data

May 5, 2004 (IT) ..... FI2004A0107

(51) Int. Cl.
*B21B 27/03* (2006.01)
*B25F 5/02* (2006.01)

(52) U.S. Cl. ..... 425/368; 425/363; 156/582; 492/38; 492/40; 242/573.2; 242/574.4

(58) Field of Classification Search ..... 492/4, 20, 492/21, 16, 15, 38, 39, 40, 45; 92/76, 51, 92/54; 101/23, 22, 5, 6, 378, 382.1, 383, 101/375, 328, 246; 242/571.1, 571.2, 574.4, 242/574, 574.1, 574.2, 574.3, 576.1, 576, 242/573.2; 425/368; 156/582
See application file for complete search history.

(56) References Cited

U.S. PATENT DOCUMENTS

| | | | | |
|---|---|---|---|---|
| 4,917,013 | A * | 4/1990 | Katz | 101/375 |
| 5,168,808 | A | 12/1992 | Prem | |
| 6,129,017 | A * | 10/2000 | Mohrmann et al. | 101/376 |
| 6,398,701 | B1 * | 6/2002 | Mohrmann | 492/39 |
| 6,470,945 | B1 | 10/2002 | Biagiotti | |
| 6,578,617 | B1 | 6/2003 | Biagiotti | |

(Continued)

FOREIGN PATENT DOCUMENTS

EP 0 370 972 B1 11/1992

(Continued)

OTHER PUBLICATIONS

Oota Yoshikazu: Holder for Cutting-Off Operation; Patent Abstracts of Japan, vol. 007, No. 074, Mar. 26, 1983 and JP 58-004304 A (Kanto Tokushu Seikou KK), Jan. 11, 1983.

*Primary Examiner* — Philip C Tucker
*Assistant Examiner* — William P Bell
(74) *Attorney, Agent, or Firm* — Breiner & Breiner, L.L.C.

(57) ABSTRACT

An embossing roller for processing a web material comprises a central axle (53) and a removable and interchangeable outer sleeve (51); the interchangeable sleeve has an essentially cylindrical outer surface provided with protuberances and/or cavities. The axle has radially expandable elements (61) to clamp the sleeve.

17 Claims, 5 Drawing Sheets

U.S. PATENT DOCUMENTS

2004/0255804 A1 * 12/2004 Hoffmann et al. ..... 101/375

FOREIGN PATENT DOCUMENTS

| | | | | |
|---|---|---|---|---|
| EP | 0 836 928 | A1 | | 4/1998 |
| EP | 1 075 387 | B1 | | 11/2003 |
| GB | 2388886 | A | * | 11/2003 |
| IT | 1210560 | B | | 9/1989 |
| JP | 58004304 | A | * | 1/1983 |
| JP | 64-36136 | | | 3/1989 |
| JP | 01-99694 | | | 7/1989 |
| WO | WO 03/045679 | A1 | | 6/2003 |
| WO | WO 03/045680 | A1 | | 6/2003 |

* cited by examiner 31p
29
31
V1
25
21
33
35
23p
27
23
30
41p
41
V3
43

ROLLER WITH INTERCHANGEABLE SLEEVE FOR EMBOSSING UNITS AND EMBOSSING UNITS COMPRISING SAID ROLLER

TECHNICAL FIELD

The present invention relates to machines or devices for embossing web or sheet materials, in particular although not exclusively paper, especially tissue paper, of the type used to produce rolls of toilet paper, kitchen towels, paper handkerchiefs and napkins or the like.

PRIOR ART

In the processing of web or sheet materials, such as and in particular tissue paper, a so-called embossing process is frequently performed, wherein the material is fed through a nip between two rollers provided with protrusions and/or protuberances, or one provided with protrusions and the other with a smooth and yielding surface, or yet again between one roller provided with protuberances and another provided with corresponding cavities. Passing through the nip between the two rollers (which may or may not be pressed against each other depending on the material used and the morphology of the surface of the rollers) the material is deformed permanently with partial breakage of the fibers of which it is composed. Embossing produces protuberances on the material of a form corresponding to the form of the protuberances of the embossing roller or rollers used.

Embossing is used, above all in the tissue paper converting field, to obtain particular technical-functional effects, such as increased softness, increased thickness, increased absorption capacity and also to obtain decorative effects. The object of embossing can also be to join two or more plies together, or to prepare one or more plies to receive a glue by means of which the two or more plies are joined by laminating them between two embossing rollers, between an embossing roller and a laminating roller or in any other suitable way.

Examples of embossing units in various configurations are described in U.S. Pat. No. 6,578,617, in U.S. Pat. No. 6,470,945, in European patent no. 1,075,387, in European patent no. 370,972 and in many other patents pertaining to the same technical field.

Recently, the need has been increasingly felt to customize the product, especially in the field of tissue paper converting. Various manufacturers wish to customize their product by using particular patterns produced by embossing, optionally combined with background embossing which provides the product with special technical-functional characteristics. Frequently, manufacturers of tissue paper items wish to offer their customers products characterized by different and variable patterns.

Engraving of the embossing rollers is an extremely costly operation and therefore these rollers are very expensive. The need to obtain different patterns, interchangeable with one another, is therefore a large investment for the paper converter, who must have numerous embossing rollers.

In order to reduce the incidence of these costs, embossing systems have been designed in which the embossing roller is composed of a central core and of an interchangeable sleeve. In this way different interchangeable sleeves can be mounted on the same core to use various alternative patterns.

Embossing rollers composed of a central core and of an interchangeable sleeve have some constructional problems, mainly deriving from the difficulty in adequately clamping the sleeve on the central core, also in view of the very high mechanical stresses to which these components are subjected during operation.

A further critical aspect is represented by the need to produce the interchangeable sleeves and the core with surfaces that correspond with each other to guarantee concentricity between the axis of rotation and the outer cylindrical surface of the interchangeable sleeve.

Embodiments of embossing rollers comprising an axle and an interchangeable sleeve with different mechanisms to clamp the sleeve on the axle are described in EP-A-0.836.928, WO-A-03/045679 and WO-A-03/045680.

OBJECTS AND SUMMARY OF THE INVENTION

The object of the present invention is to provide a new type of embossing roller with interchangeable sleeve which is particularly reliable with regard to reciprocal clamping between sleeve and central axle.

Essentially, the invention relates to an embossing roller for processing a web material, comprising a central axle and a removable and interchangeable outer sleeve, the interchangeable sleeve having an essentially cylindrical outer surface provided with protuberances and/or cavities, characterized in that said axle has radially expandable elements to clamp the sleeve.

Expandable axles are known. They are used in the industry of paper converting or converting of other web materials, to hold the tubular cores, normally made of cardboard or similar materials, about which the paper is wound or from which the web material is unwound to form reels or to unwind reels of web material. An example of an expandable axle of this type is described in GB-A-2,388,886. These axles usually have a pneumatic drive system of the expandable elements arranged on the cylindrical surface thereof. The use of this type of expandable axles to produce embossing rollers with an interchangeable sleeve is not known.

Advantageously, according to a preferred embodiment of the invention, the radially expandable elements are controlled by mechanical members, in turn operated, for example, by one or more hydraulic or preferably pneumatic piston-cylinder actuators, preferably disposed at the level of one or both ends of the expandable axle.

In a particularly advantageous embodiment of the invention, the expandable elements comprise a plurality of expandable blocks disposed on the axle. Preferably, the expandable blocks are of limited length, substantially smaller than the axial length of the expandable axle.

Advantageously, these expandable blocks are distributed according to annular arrangements aligned on said expandable axle. In practice, a plurality of annular rings are provided along the extension of the expandable axle, for example 5-10 annular rings of expandable blocks, with a mechanism inside the axle which causes essentially simultaneous retraction of all the blocks when the interchangeable sleeve requires to be inserted on or removed from the axle.

To obtain efficient and reliable clamping, in a particular embodiment of the invention, the expandable blocks are controlled by struts inside the axle. The struts can be associated with spring mechanisms which stress the struts in a radial position, corresponding to the position of maximum expansion of the blocks, while one or more actuators are provided to compress the springs causing inward oscillation of the struts, and consequently retraction of the expandable blocks, to allow the movement to insert and/or remove the sleeve.

Further advantageous characteristics and embodiments of the roller according to the invention are indicated in the appended claims and shall be described in detail with reference to an example of embodiment. These characteristics can also be implemented in an expandable axle on which a different element with respect to an interchangeable sleeve is clamped.

According to a different aspect, the invention relates to an embossing unit comprising at least one embossing roller produced as described above.

According to yet another aspect, an expandable axle is provided, which can be used as the inner axle of an embossing roller with interchangeable sleeve, comprising a tube, on which radially expandable elements are disposed and controlled by mechanical members inside the tube. The expandable elements of the axle can include a plurality of expandable blocks disposed, for example, according to annular arrangements distributed more or less evenly along the longitudinal extension of the axle. Advantageously, the expandable blocks can be controlled by struts inside the tube forming the main body of the axle. In general, the expandable axle according to the invention can have one or more of the characteristics described hereunder with reference to an example of application of said axle to produce an embossing roller. These characteristics can be combined in various ways with one another to produce an expandable axle which can also be applied advantageously for other uses.

BRIEF DESCRIPTION OF THE DRAWINGS

The invention shall be better understood by following the description and accompanying drawing, which shows a non-limiting practical embodiment of said invention. In the drawing.

DETAILED DESCRIPTION OF THE PREFERRED EMBODIMENT OF THE INVENTION

Figure 1:
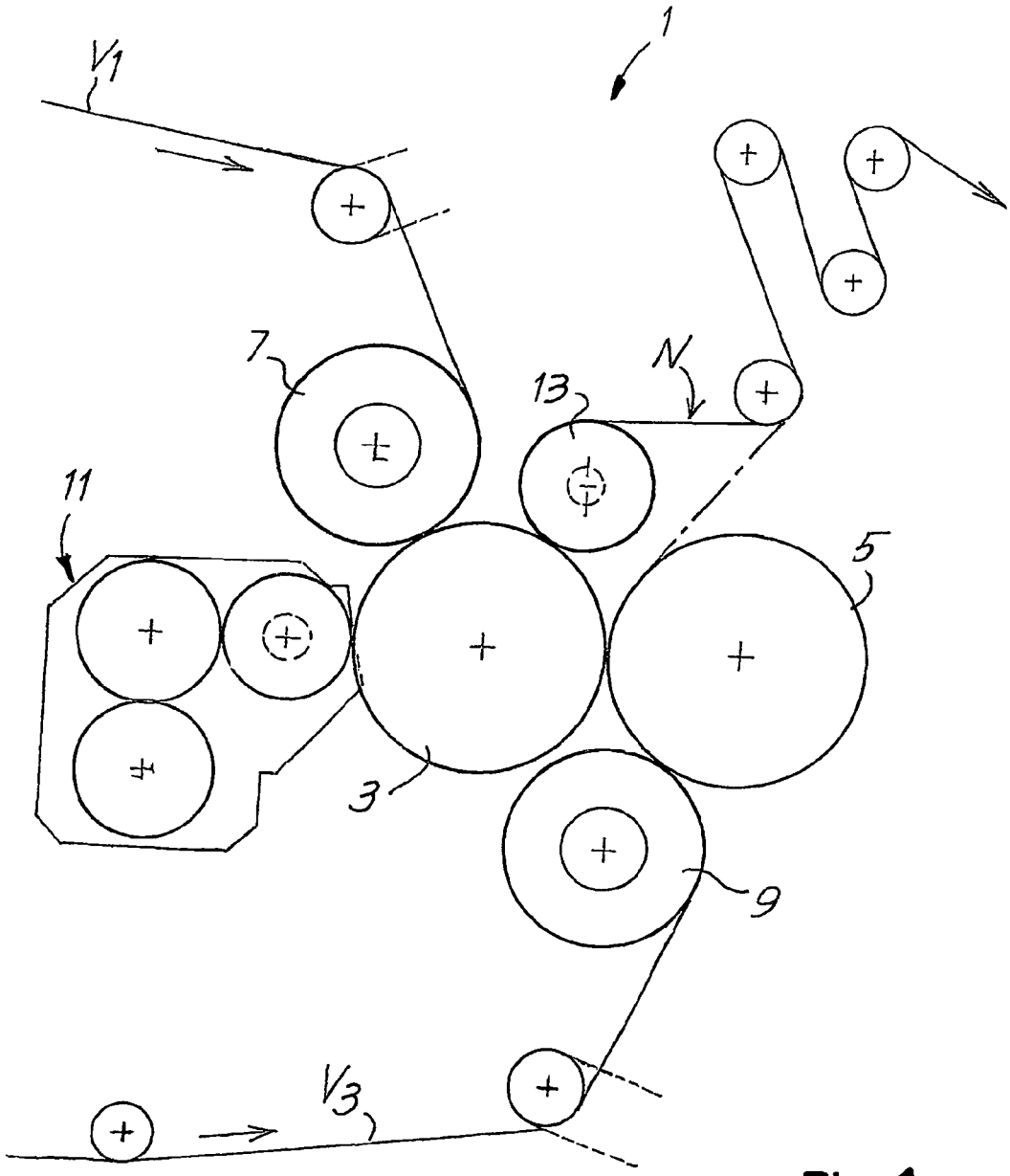
FIGS. 1 and 2 schematically show two configurations of embossing-laminating units in which the invention can be incorporated.
Figure 2:
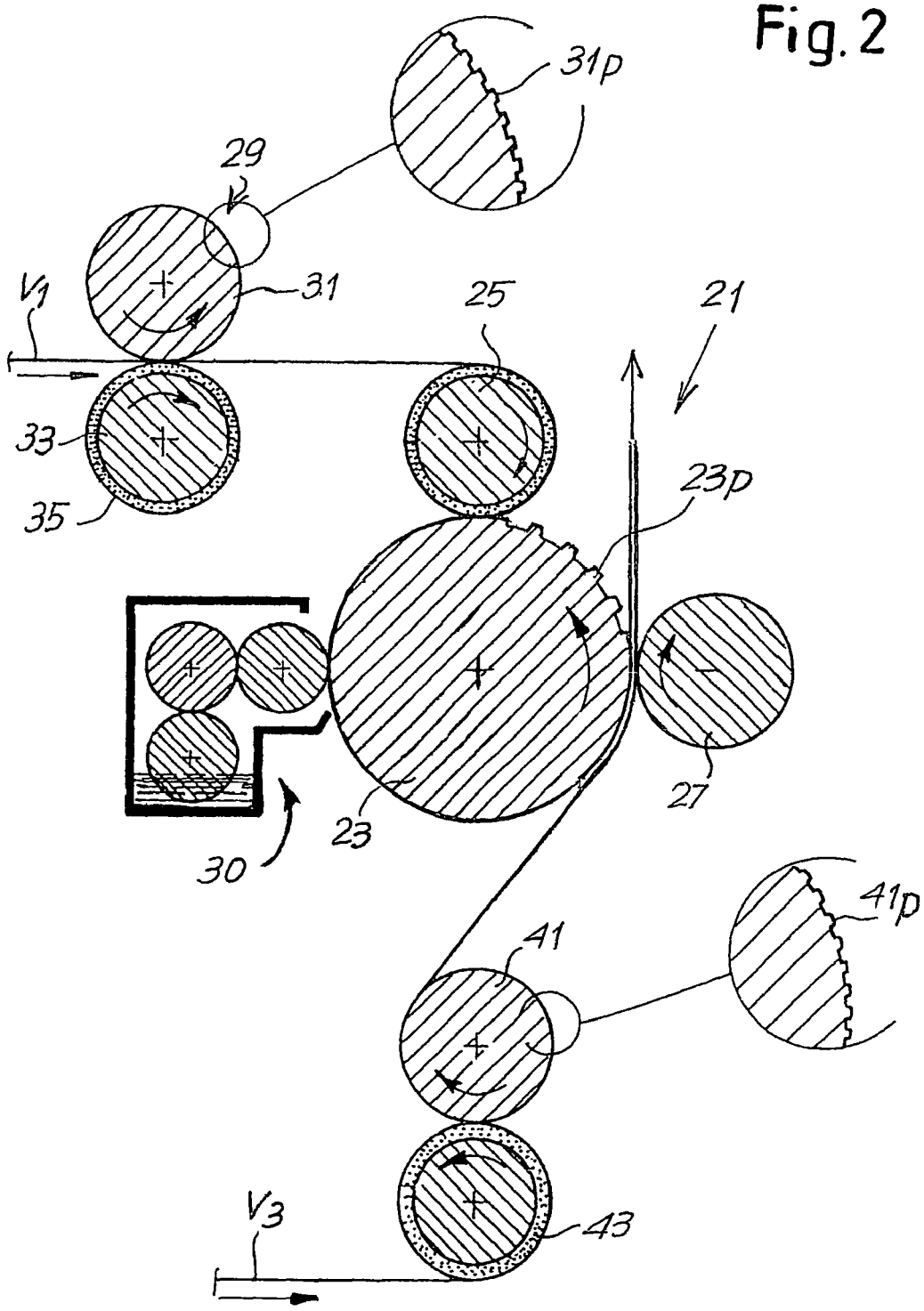

FIGS. 1 and 2 schematically show two embossing-laminating units of different configuration in which rollers produced with an axle and interchangeable sleeve according to the invention can be used. It must be understood that the embossing-laminating units in FIGS. 1 and 2 are only two examples of possible machinery in which the invention can be advantageously used.

With reference to FIG. 1, the embossing-laminating unit, indicated as a whole with 1, comprises a first embossing, roller 3 and a second embossing roller 5 with parallel axes forming a nip therebetween. The embossing rollers 3 and 5, which are provided on the surfaces thereof with protuberances obtained by means of engraving using any available technique, both cooperate with a corresponding pressure roller 7 and 9. The pressure rollers 7 and 9 are coated with a yielding material, such as plastic or rubber, and have a smooth outer surface.

Two plies V1 and V3 of web material, such as tissue paper, are fed into the nips between the rollers 3 and 7 and between the rollers 5 and 9 respectively. In this way the two plies V1 and V3 are embossed as a result of the pressure exerted by the embossing rollers 3 and 5 against the yielding surfaces of the rollers 7 and 9. On the protuberances produced on the ply V1 by the protrusions of the embossing roller 3, a glue is applied by means of a gluing unit 11, of known type represented schematically in the figure. In the nip between the embossing rollers 3 and 5 the two plies are laminated together by pressing them at the level of the corresponding protrusions or protuberances of the rollers 3 and 5. Alternatively, the two rollers 3 and 5 can be disposed with their protuberances staggered, that is, with the protuberances of the roller 5 placed opposing the cavities between the protuberances of the roller 3, or at a distance from one another and in any case without reciprocal contact between the protrusions. In this case the two plies V1 and V3 are not laminated between the rollers 3 and 5, but between the roller 3 and a secondary laminating roller 13.

Notwithstanding the embossing and laminating technique used, a multi-ply web material N composed of two plies V1 and V3, embossed and glued to each other, is obtained at the outlet of the embossing unit. Each ply can in turn be composed of more than one layer.

In the embodiment in FIG. 2, the embossing-laminating unit, indicated here with 21, comprises a principal embossing roller 23 cooperating with a pressure roller 25 with a coating in a yielding material, such as rubber and having an essentially smooth surface. A laminating roller 27 with a smooth surface, rigid or yielding, although advantageously with a rigidity greater than the cylindrical surface of the pressure roller, also cooperates with the embossing roller 23 provided with protrusions 23P.

A first ply of web material V1 is fed around the pressure roller 25 through the nip formed by this roller and by the embossing roller 23. Before passing through this nip the web material V1 passes through a secondary embossing unit, indicated as a whole with 29, and composed by an embossing cylinder or roller 31 provided with protuberances or protrusions 31P and cooperating with a pressure roller 33 coated in rubber or another yielding material.

A second ply of web material V3 is fed into the nip between the embossing roller 23 and the laminating roller 27. In this nip the ply V3 is glued against the embossed ply V1, on the protrusions or protuberances of which produced by the protuberances 23P of the embossing roller 23 a glue has been applied by means of a gluing unit 30.

The ply V3 can also advantageously be pre-embossed by means of an embossing roller 41 provided with protrusions 41P and cooperating with a pressure roller 43 coated in a yielding material such as rubber or plastic.

The configurations of these embossing-laminating units illustrated by way of examples are described in greater detail in WO-A-99/41064 and WO-A-99/44814, which should be referred to for greater details.

The embossing rollers 3, 5, 23 and optionally also the embossing rollers 31 and 41 can be produced according to the invention, with an expandable axle on which interchangeable sleeves with different embossing patterns, that is, variable arrangements of protrusions or protuberances, can be placed and clamped alternatively.

The shape of the expandable axle is shown in particular in FIGS. 3A, 3B, 4 and 5, in which the axle and interchangeable sleeve assembly (forming the embossing roller) is indicated with 3, while 51 indicates the interchangeable sleeve provided with protuberances, indicated here with 51P, and forming the protuberances of the embossing roller. The expandable axle is indicated as a whole with 53.

The expandable axle 53 comprises as principal element a tube 55, fixed to the ends of which are shanks or ends 57 and 59. Expandable elements or blocks 61 are disposed on the surface of the tube 55 according to annular groupings. Disposed along the axial extension of the expandable axle 53 is a plurality of annular arrangements of these blocks 61, the various arrangements being essentially equivalent to one another and being configured as shown in particular in the cross section in FIG. 5.

In substance, each annular arrangement of blocks 61 forms a cylindrical ring and each block has an outer surface 61A and an inner surface 61B, both cylindrical, the surface 61B having a radius essentially identical to the radius of the tube 55, while the surface 61A has a radius of curvature essentially identical to the radius of the inner surface of the interchangeable sleeve to be clamped on the axle 53.

Each block 61 is constrained axially by stop elements 63 which prevent axial movement of said blocks. Moreover, retaining element 65 are provided to limit possible radial movement of said blocks. The blocks 61 of each annular arrangement of blocks are elastically constrained to the outer surface of the tube 55 by a pair of helical springs 67 wound annularly around the axis of the tube 55.

Figure 3A:
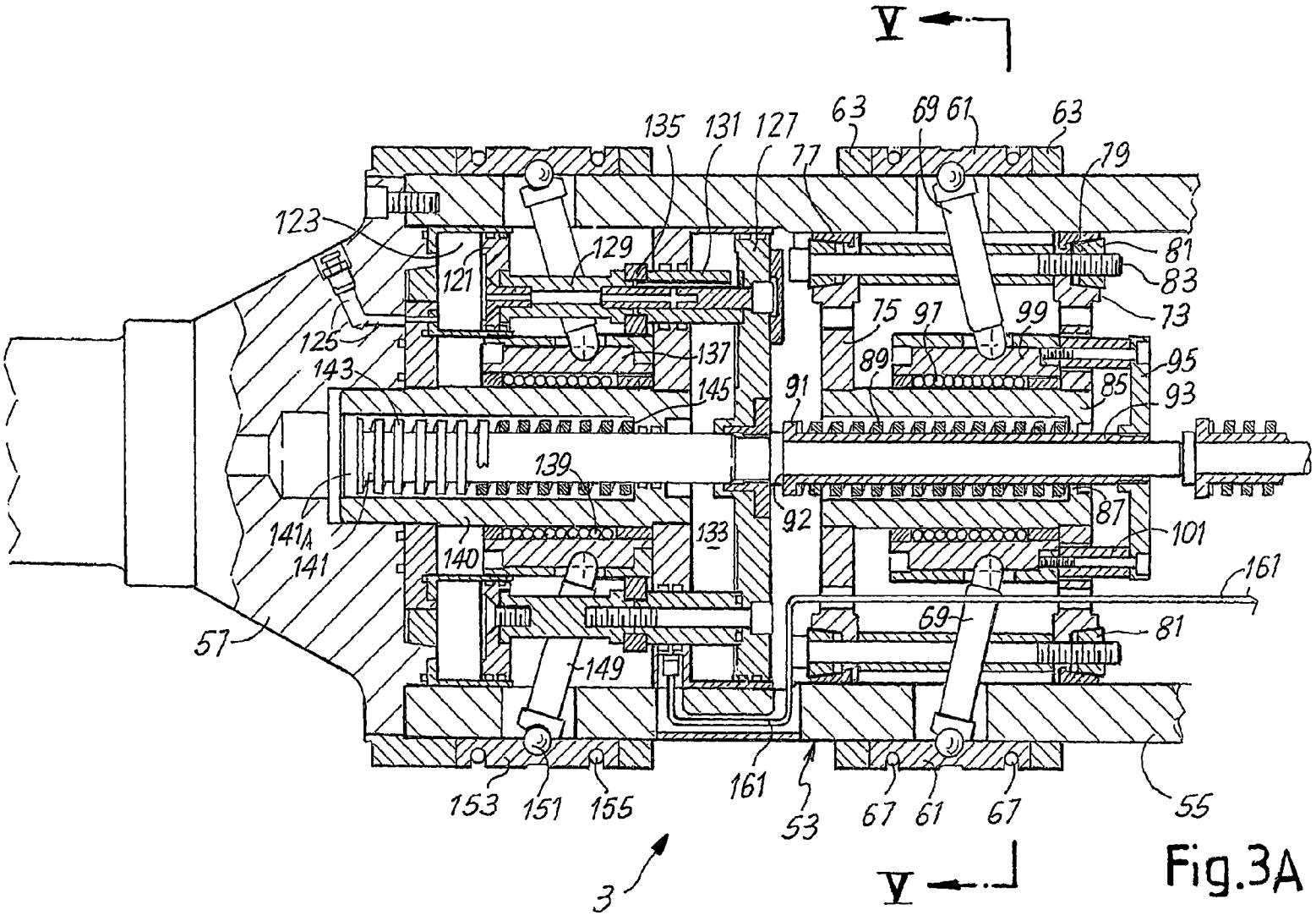
FIGS. 3A and 3B show two portions of an expandable axle in a longitudinal section.
Figure 3B:
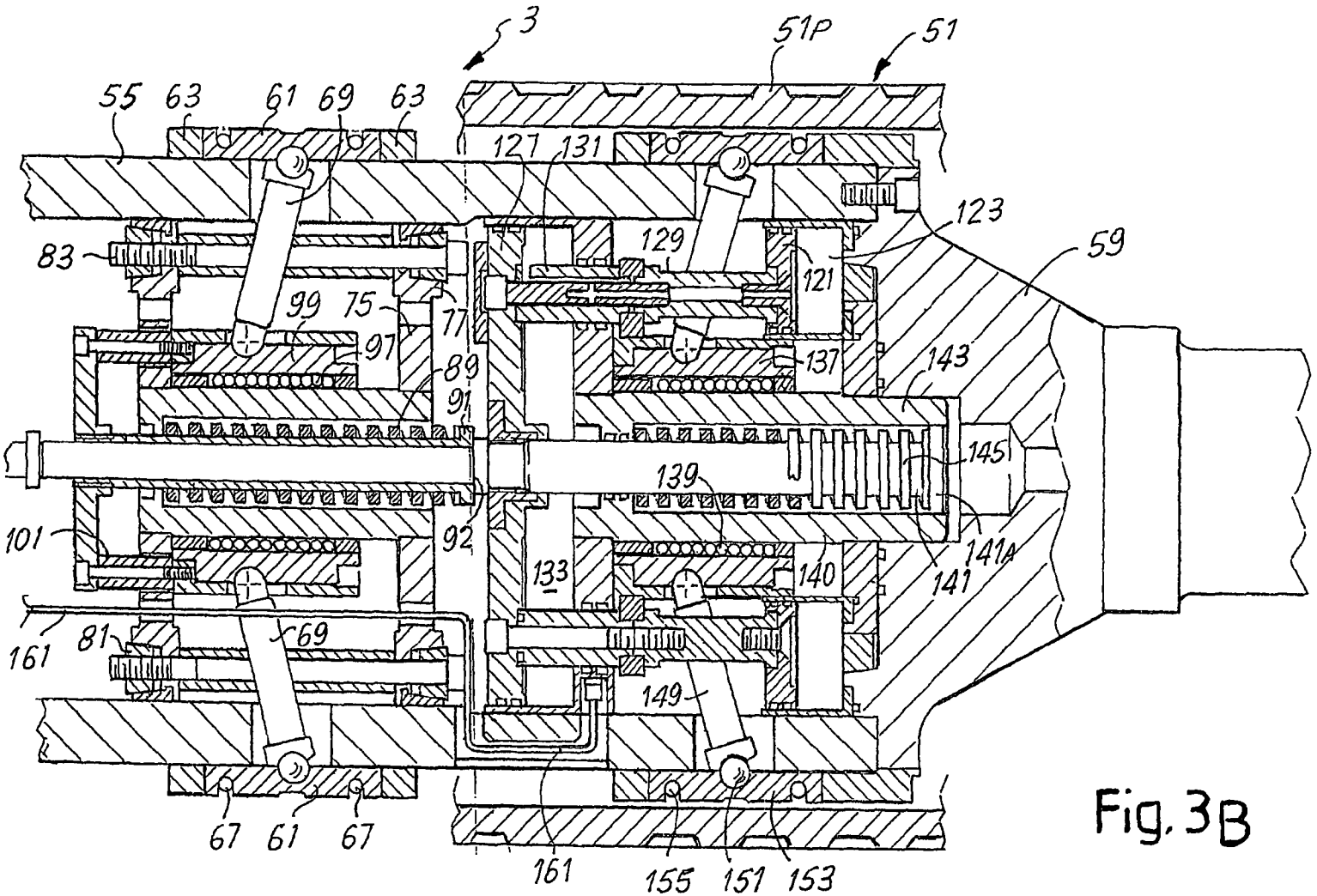
Figure 5:
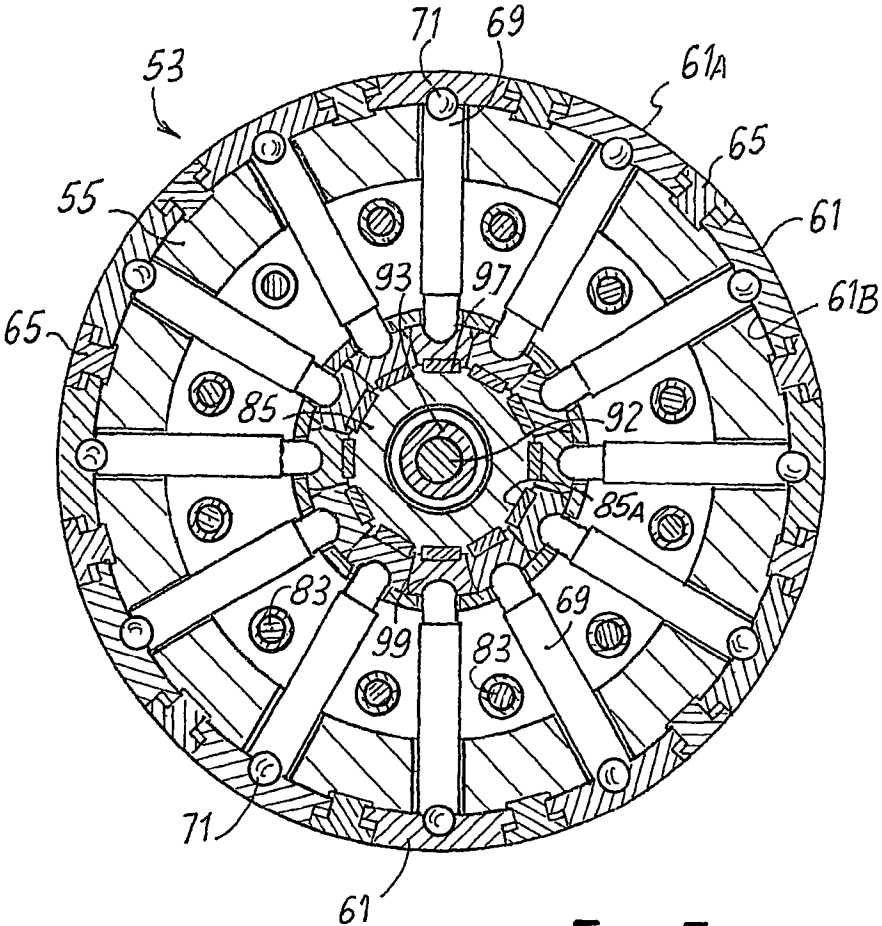
FIG. 5 shows a cross section according to V-V in FIG. 3.

Each block 61 is associated with a strut 69, a ball 71 being interposed between the distal (that is, radially outermost) end of the strut 69 and the corresponding block 61. The struts 69 can take two end positions: the first position, inclined, is represented in FIGS. 3A, 3B and corresponds to a retracted arrangement of the blocks 61; the second position, in which the blocks 61 are in the extracted position, is represented in FIG. 4 and in this arrangement the struts 69 are disposed in an essentially radial position.

Figure 4:
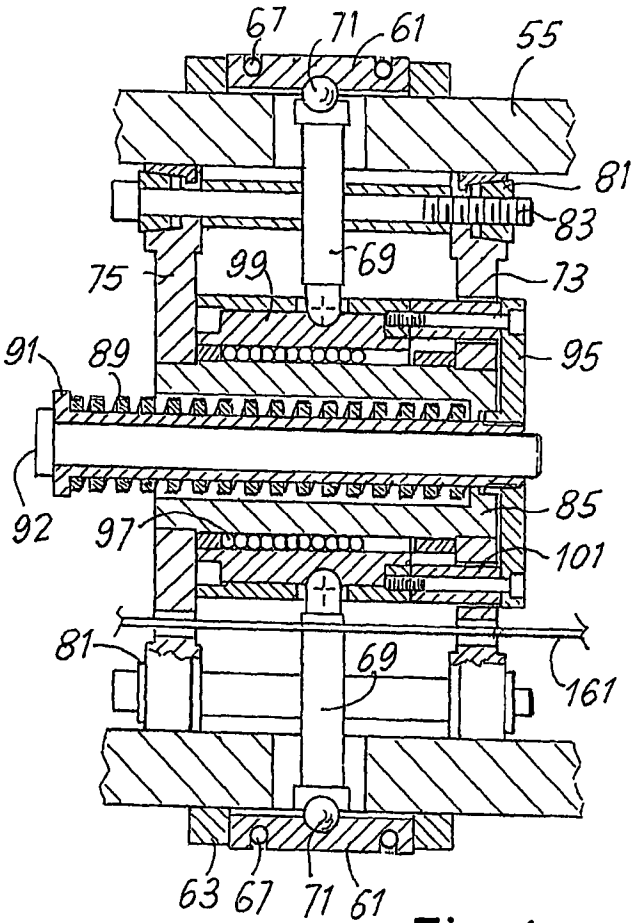
FIG. 4 shows a portion of the expandable axle in a longitudinal section and in the expanded condition.

As shall be explained hereunder, the position shown in FIG. 4 is the one in which the struts 69 and the blocks 61 are normally held, in the absence of the outer interchangeable sleeve 51, by elastic elements or members housed inside the axle 53. The retracted position in FIGS. 3A, 3B is taken, to insert the sleeve 51, by means of a pneumatic actuator, or preferably, as in the example illustrated, a pair of pneumatic actuators disposed at the ends of the axle and illustrated subsequently. When the interchangeable sleeve is mounted on the axle 53 the blocks 61 are disposed in a slightly more retracted position with respect to the one in FIG. 4, as the inner diameter of the sleeve 51 is smaller than the outer diameter of the surface defined by the blocks 61 in their condition of maximum expansion, in order to guarantee correct clamping of the sleeve.

Inside the tube 55, at the level of each annular group or annular arrangement of blocks 61, are two flanges 73, 75 clamped against the inner cylindrical surface of the tube 55 by means of conical rings 77, 79 and counter-cones 81 which are clamped in pairs by means of threaded tie-rods 83. The arrangement is such that after assembly the flanges 73, 75 of each pair are clamped rigidly inside the tube 55. Rigidly constrained to each pair of flanges 73, 75, is a bush or bushing 85, rigidly connected to said flanges. Each bushing 85 has a shoulder or inner annular projection 87, against which an elastic member, in the form of a helical compression spring 89, reacts, said spring being held in an at least partially compressed condition between the shoulder 87 and an annular projection 91 produced in a corresponding rod or hollow pin 93. The pin 93 is constrained, by means of a thread, to a flange 95, which moves axially integral with the pin 93.

Produced on the outer surface of the bushing 85 are tracks, in the same number as the number of expandable blocks 61, indicated with 85A, for corresponding groups of rollers 97 or other revolving bodies of suitable shape. The rollers 97 associated with each track 85A act as revolving bodies for the sliding of respective shoes 99, each of which is constrained by means of an element 101 to the common flange 95. In this way sliding of the pin 93 inside the bushing 85 and therefore sliding of the flange 95 causes a corresponding and simultaneous movement in an axial direction of the shoes 99.

Hinged to each shoe 99 is the end of a relative strut 69, opposite the end of the strut constrained by means of the ball 71 to the block 61. In this way, simultaneous sliding of the shoes 99 causes oscillation and translation of the struts 69 and therefore simultaneous expansion or retraction of the expandable blocks 61 when the pin 93 moves in accordance with or in contrast to the action of the compression spring 89.

Disposed inside the tube 55 forming the main body of the expandable axle 53 are a plurality of mechanical members of the type described above to cause expansion or retraction of a corresponding plurality of annular arrangements of blocks 61. In the way described hereunder, in the absence of a force applied by the end actuators, the various springs 89 tend to carry the spindles 93 and therefore the shoes 99, with the respective struts 69 to the position in FIG. 4, with the corresponding expandable blocks 61 positioned in the radially expanded position.

To control retraction of the blocks 61, in the example illustrated the axle 53 has actuators at both ends, that is, associated with both shanks or ends 57, 59 to cause compression of the springs 89 and therefore retraction of the blocks 61 when a sleeve 51 is to be inserted on the axle 53 or removed therefrom. Hereinafter, the actuator associated with the shank 57 will be described initially in detail, the actuator associated with the shank 59 being essentially symmetrical with the exception of some differences to be illustrated subsequently. It must be understood that alternatively a single end actuator could be used, especially for axles of limited axial length.

Associated with the shank 57 is a piston 121, toroidal or annular in shape, which slides in a chamber, also toroidal or annular, indicated with 123. The toroidal chamber 123, which extends around the geometrical axis of the expandable axle 53, can be filled with pressurized air through a plurality of passages 125 provided in the shank 57. The toroidal or annular piston 121 is rigidly coupled to a second piston 127 by means of a connection formed by two spacers 129 and 131 connected and coaxial with each other, produced inside which and inside the respective screws for reciprocal clamping and for clamping to the pistons 121 and 127, is a passage which fluidly connects the chamber 123 with the chamber 133 inside which the piston 127 slides. With this arrangement the pressurized air fed through the ducts 125 pressurizes both the chamber 123 and the chamber 133 pushing the pistons 121 and 127, which move rigidly with each other, from left to right (in the drawing).

Clamped between each spacer 129 and the corresponding spacer 131, connected rigidly to each other, is a flange 135, constrained to which in turn are shoes 137 similar to the shoes 99, sliding on rollers 139 housed in seats produced on the outer surface of a bushing 140, rigidly connected to the shank 57. Sliding inside the bushing 140 is a spindle or pin 141 with a head 141A against which a compression spring 143 reacts, said spring being held between said head 141A and a shoulder or inner annular projection 145 of the bushing 140. The spindle or pin 141 is rigidly connected to the piston 127.

As a result of the arrangement described a movement from left to right (in the drawing) of the pistons 121, 127, caused by the input of compressed air through the passages 125, causes a corresponding axial movement of the shaft or rod 141 and a corresponding compression of the spring 143. The movement of the pistons 121, 127 also causes an analogous movement of the shoes 137. Hinged thereto are the radially innermost ends of struts 149 equivalent to the struts 69 already described, the radially outermost ends of which are constrained, by means of balls 151, to expandable blocks 153 equivalent to the blocks 61.

In the arrangement illustrated in FIG. 3A the compression spring 143 is compressed in the same way as the springs 89 and the pistons 121 and 127 are in their position translated towards the right with the chambers 123 and 133 completely expanded. The shoes 137 are in the position completely-translated to the right corresponding to a position of maximum inclination (with respect to the radial position) of the struts 149 and therefore a completely retracted position of the expandable blocks 153. Just as the blocks 61, these are held by helical springs wound annularly around said blocks and indicated with 155, which, in the same way as the springs 67 hold the blocks against the balls 71, 151 and against the distal ends of the struts 69, 149 when said struts are in the position of maximum inclination.

When the pressure in the chambers 123 and 133 is discharged the compression spring 143 returns the pistons 121 and 127 to the position moved farthest to the left.

As can be seen in FIG. 3A, in the position of maximum compression of the spring 143, the piston 127 is resting against a rod 92 housed coaxially inside the pin 93 associated with the first group of expandable blocks 61. The rod 92 has a head which comes to rest against the head 91 of the pin 93 inside which it is housed, and an opposite end which comes to rest against the corresponding head of the rod 92 associated with the hollow pin 93 of the adjacent mechanism (that is, associated with the subsequent annular group of blocks 61) and so forth.

In this way with a single actuator composed by a pair of pistons 121, 127 rigidly connected to each other and respective chambers 123 and 133 it is possible to compress both the spring 143 and all the springs 89 disposed in the various mechanisms positioned in succession inside the tube 55. This causes simultaneous retraction of all the expandable blocks 61 and 153 with movement of the struts 149 and 69 to the inclined position shown in FIG. 3A.

In actual fact, inside the axle 53 about half of the expansion and retraction mechanisms of the blocks 61 are disposed in series to be operated by the actuator associated with the shank 57. In fact, associated with the opposite shank 59 the expandable shaft or axle 53 is an actuator, specular to the one described above, the purpose of which is to cause retraction of the blocks 153 associated with the shank 59 and the blocks 61 of a certain number of series of blocks 61 located in the half of the expandable axle 53 nearest the shank 59.

In this way a balanced mechanism is obtained where two actuators associated with the two ends of the axle are used to cause retraction or expansion of respective expandable blocks 61 distributed in the two halves of the axle. It must be understood that distribution of the blocks may not be exactly symmetrical, and therefore the actuator associated with the shank 57 can control a greater or lesser number of series of blocks 61 with respect to those, operated by the actuator associated with the shank 59.

As can be seen in FIG. 3B, the actuator associated with the shank 59 is configured in an essentially symmetrical way to the one associated with the shank 57 and identical or equivalent parts are marked with the same reference numbers. Nonetheless, contrary to what occurs for the actuator associated with the shank 57, which is operated by a pressurized fluid input through ducts 125 produced in said shank 57, the actuator associated with the shank 59 receives the operating fluid from inside the axle 53 through one of more ducts 161 which join the chamber 133 of the actuator associated with the shank 57 to the corresponding chamber 133 of the actuator associated with the shank 59. The chamber 133 of the after is then fluidly connected to the chamber 123. This allows the compressed air (or other operating fluid) to be supplied from only one side of the roller, thereby facilitating operations to insert and remove the interchangeable sleeve 51, said operations being performed on the side of the shank 59.

It will be understood from the above description that the operating mechanism of the blocks 61 allows the interchangeable sleeve 51 to be clamped and released in a reliable way to allow easy removal and replacement and at the same time to guarantee efficient and reliable clamping even at the high stresses at which the embossing rollers normally operate. The spring and strut mechanism in fact allows a radial force to be exerted on the sleeve 51 and therefore an extremely high frictional force which prevents both axial sliding and reciprocal rolling of the sleeve 51 on the expandable axle 53. The symmetrical arrangement of the struts about the geometrical axis of the expandable axle 53 and the arrangement of the axial compression springs prevents negative effects due to the fact that a radial stress is exerted on the sleeve, distributed along a generatrix representing the line of contact of the embossing roller with the corresponding pressure roller or with the opposed embossing roller with which it cooperates, in the case of tip-to-tip embossing.

It is understood that the drawing merely shows an example provided purely as a practical embodiment of the invention, which may vary in forms and arrangements without however departing from the scope of the concept on which the invention is based.

The invention claimed is:

1. An embossing roller for processing a web material, said roller comprising a central axle and a removable and interchangeable outer sleeve, said outer sleeve having an essentially cylindrical outer surface provided with protuberances and/or cavities, wherein said central axle has a plurality of radially expandable elements to clamp the outer sleeve, said plurality of radially expandable elements being controlled by mechanical members; wherein said plurality of radially expandable elements are distributed along said central axle in a plurality of annular arrangements; and wherein means to transfer control from one of said plurality of annular arrangements to another of said plurality of annular arrangements is provided, said means to transfer control for each of said plurality of annular arrangement comprising a hollow rod connected to a set of sliding shoes with each shoe being connected to a strut which is structured to act upon a respective expandable element of one of said annular arrangements, and said shoe is structured to cause, upon sliding thereof, radial movement of said expandable element;

a compression spring;

an inner rod slidingly arranged in said hollow rod, and acting on an adjacent inner rod of an adjacent annular arrangement, said compression spring applying a force biasing said inner rod, said hollow rod, said sliding shoes and said strut for each of said sliding shoes towards an expanded position of said expandable elements;

at least one actuator arranged at least at one end of said roller and acting on said inner rod;

wherein said inner rod is in mutual contact with and is pushed by one of said at least one actuator such that said actuator is provided with axial movement which is transmitted to said plurality of annular arrangements of said radially expandable elements through said inner rod, action of said actuator causing retraction of said expandable elements of said annular arrangements against the force of said compression spring.

2. The roller as claimed in claim 1, wherein said struts are disposed according to approximately radial arrangements.

3. The roller as claimed in claim 1, wherein said expandable elements comprise a plurality of expandable blocks disposed on said central axle.

4. The roller as claimed in claim 3, wherein said each shoe is hingedly connected to said strut, and sliding of said shoes causes variation in inclination of said struts and consequent extension or retraction of the expandable blocks.

5. The roller as claimed in claim 4, wherein said shoes are slidingly guided on bushings coaxial to said central axle.

6. The roller as claimed in claim 5, wherein said strut constrained to said each shoe slides in a seat produced in a common bushing.

7. The roller as claimed in claim 3, wherein said compression spring stresses said expandable blocks in an expanded position.

8. The roller as claimed in claim 7, wherein said compression spring is housed in a respective bushing.

9. The roller as claimed in claim 8, wherein the compression spring is held between a head of said hollow rod and the respective bushing.

10. The roller as claimed in claim 9, wherein each said hollow rod is disposed coaxially inside said central axle.

11. The roller as claimed in claim 9, wherein each said hollow rod is aligned with one another and disposed resting against one another, at least one actuator at one end of said roller being provided to axially push each said hollow rod against action of a respective spring therefor, compression of each said spring being caused by sliding of each said hollow rod determining retraction of the expandable blocks.

12. The roller as claimed in claim 11, further comprising two actuators, each of said two actuators being associated with a respective end of said central axle, to control a respective portion of the expandable blocks.

13. The roller as claimed in claim 11, wherein said at least one actuator is a piston-cylinder actuator.

14. The roller as claimed in claim 13, wherein said at least one actuator is supplied with an operating fluid at only one end of said central axle, an inner duct being provided to supply an actuator associated with an opposite end of said central axle.

15. The roller as claimed in claim 11, wherein said at least one actuator comprises a double piston-cylinder system.

16. The roller as claimed in claim 11, wherein said at least one actuator has a piston which is rigidly constrained to a series of shoes to control a respective series of expandable end blocks.

17. An embossing unit comprising at least one embossing roller, said at least one embossing roller comprising a central axle and a removable and interchangeable outer sleeve, wherein said outer sleeve has an essentially cylindrical outer surface provided with protuberances and/or cavities, and wherein said central axle has a plurality of radially expandable elements to clamp the outer sleeve, said plurality of radially expandable elements being controlled by mechanical members; and wherein said plurality of radially expandable elements are distributed along said central axle in a plurality of annular arrangements; and wherein means to transfer control from one of said plurality of annular arrangements to another of said plurality of annular arrangements is provided, said means to transfer control for each of said plurality of annular arrangement comprising a hollow rod connected to a set of sliding shoes with each shoe being connected to a strut which is structured to act upon a respective expandable element of one of said annular arrangements, and said shoe is structured to cause, upon sliding thereof, radial movement of said expandable element;

a compression spring;

an inner rod slidingly arranged in said hollow rod, and acting on an adjacent inner rod of an adjacent annular arrangement, said compression spring applying a force biasing said inner rod, said hollow rod, said sliding shoes and said strut for each of said sliding shoes towards an expanded position of said expandable elements;

at least one actuator arranged at least at one end of said roller and acting on said inner rod;

wherein said inner rod is in mutual contact with and is pushed by one of said at least one actuator such that said actuator is provided with axial movement which is transmitted to said plurality of annular arrangements of said radially expandable elements through said inner rod, action of said actuator causing retraction of said expandable elements of said annular arrangements against the force of said compression spring.

* * * * *